US010723432B2

(12) United States Patent
Danielsson et al.

(10) Patent No.: US 10,723,432 B2
(45) Date of Patent: Jul. 28, 2020

(54) METHOD FOR CONTROLLING THE FUEL CONSUMPTION OF A SHIP

(71) Applicant: Lean Marine Sweden AB, Göteborg (SE)

(72) Inventors: Håkan Danielsson, Göteborg (SE); Nicklas Karlsson, Hovås (SE); Linus Ideskog, Öckerö (SE)

(73) Assignee: Lean Marine Sweden AB (SE)

( * ) Notice: Subject to any disclaimer, the term of this patent is extended or adjusted under 35 U.S.C. 154(b) by 166 days.

(21) Appl. No.: 15/567,201

(22) PCT Filed: Apr. 20, 2016

(86) PCT No.: PCT/EP2016/058773
§ 371 (c)(1),
(2) Date: Oct. 17, 2017

(87) PCT Pub. No.: WO2016/169991
PCT Pub. Date: Oct. 27, 2016

(65) Prior Publication Data

US 2018/0050782 A1 Feb. 22, 2018

(30) Foreign Application Priority Data

Apr. 20, 2015 (SE) ..... 1500189

(51) Int. Cl.
*B63H 21/38* (2006.01)
*B63H 21/14* (2006.01)
(Continued)

(52) U.S. Cl.
CPC ..... *B63H 21/38* (2013.01); *B63H 3/10* (2013.01); *B63H 21/14* (2013.01); *B63H 21/21* (2013.01);
(Continued)

(58) Field of Classification Search
CPC ..... B63H 21/38; B63H 21/14; B63H 21/21; B63H 21/22; B63H 3/10; B63H 2021/216; F02D 29/02; B63J 2099/006
See application file for complete search history.

(56) References Cited

U.S. PATENT DOCUMENTS 5,070,832 A * 12/1991 Hapka et al. ..... 123/198 D
6,379,114 B1 * 4/2002 Schott et al. ..... B63H 3/10 416/1
(Continued)

FOREIGN PATENT DOCUMENTS

EP 0048587 A1 3/1982
JP 2013006531 A * 1/2013 ..... B63H 3/10
(Continued)

OTHER PUBLICATIONS

Espacenet translation of JP2013006531A, Jan. 10, 2103, Kishimoto, 37 pages (Year: 2013).*
(Continued)

*Primary Examiner* — Dale W Hilgendorf
(74) *Attorney, Agent, or Firm* — Lerner, David, Littenberg, Krumholz & Mentlik, LLP

(57) ABSTRACT

The present invention relates to a method for controlling the fuel consumption of a ship, the ship comprising an engine and a controllable pitch propeller, wherein torque and engine speed are adjusted to correspond to an output set point value. The adjustment is such that the engine is operated in an operating condition with an engine speed and a propeller pitch of the controllable pitch propeller such that the fuel consumption of the ship is brought and/or held within a desired fuel consumption range.

16 Claims, 4 Drawing Sheets

(51) Int. Cl.

| | |
|---|---|
| ***B63H 3/10*** | (2006.01) |
| ***F02D 29/02*** | (2006.01) |
| ***B63H 21/21*** | (2006.01) |
| ***B63H 21/22*** | (2006.01) |
| ***B63B 79/00*** | (2020.01) |

(52) U.S. Cl.
CPC ..... *B63H 21/22* (2013.01); *F02D 29/02* (2013.01); *B63B 79/00* (2020.01); *B63H 2021/216* (2013.01)

(56) References Cited

U.S. PATENT DOCUMENTS

| | | | | |
|---|---|---|---|---|
| 6,457,466 | B1 * | 10/2002 | Ritter et al. | F02D 41/1446 123/676 |
| 8,545,278 | B2 * | 10/2013 | Rzadki et al. | B63H 21/20 440/1 |
| 9,446,833 | B2 * | 9/2016 | Flodgaard | F02D 29/02 |
| 2009/0030595 | A1 * | 1/2009 | Sugai | F02D 29/02 701/112 |
| 2010/0167601 | A1 | 7/2010 | Rzadki et al. | |
| 2014/0067236 | A1 * | 3/2014 | Henry et al. | F02D 41/1446 701/104 |

FOREIGN PATENT DOCUMENTS

| | | | |
|---|---|---|---|
| JP | 2013006531 | A | 1/2013 |
| WO | 8203831 | A1 | 11/1982 |
| WO | 2008145684 | A1 | 12/2008 |
| WO | 2014059995 | A1 | 4/2014 |

OTHER PUBLICATIONS

International Search Report for Application PCT/EP2016/058773 dated Sep. 30, 2016.

* cited by examiner

METHOD FOR CONTROLLING THE FUEL CONSUMPTION OF A SHIP

CROSS-REFERENCE TO RELATED APPLICATIONS

The present application is a national phase entry under 35 U.S.C. § 371 of International Application No. PCT/EP2016/058773, filed Apr. 20, 2016, published in English, which claims priority from Swedish Application No. 1500189-4 filed Apr. 20, 2015, the disclosures of which are incorporated herein by reference.

BACKGROUND

A controllable pitch ship propeller is designed such that the angle of attack of the blade can be continuously varied. In this manner, the torque of the main engine may be varied. A controllable pitch propeller is common for medium sized ships (50-150 m l.b.p.) with medium to high requirements on maneuverability.

A controllable pitch propeller is often combined with a shaft generator connected to the main engine via a gear box. When operating such a configuration, the propulsion effect is adjusted solely by varying the pitch of the propeller blades. The engine speed of the main engine is kept constant in order to maintain the generator frequency within allowable limits.

As long as the ship is operating close to its design speed, a fixed engine speed is not a problem from an efficiency point of view, but at lower speed of the ship a full engine speed and a low torque provides a substantially lower efficiency of the propulsion system as a whole. At lower speed of the ship, so called "slow steaming", it is from an efficiency point of view appropriate to vary both the pitch and the engine speed, a so called combination operation.

The majority of present operating systems for controllable pitch propellers have a combination condition wherein both the pitch and the engine speed can be controlled simultaneously using the same operating lever. The relationship between the pitch and the engine speed is fixed and is calculated with a margin for different load conditions and in order not to exceed the load limit curve of the engine. During operation in a combination condition, the shaft generator cannot be used, but electricity can instead be generated using any one of the ship's auxiliary engines.

The fixed combination curve has the disadvantage that it is calculated with a margin to the maximum allowable load for the engine. This results in that the maximum efficiency of the engine only can be achieved under one condition at the most.

Moreover, most of the existing control systems have a safety function, a "Load Control", limiting the maximum torque for the main engine in order to limit the pitch from exceeding a value that can be set. This renders the engine speed higher and the torque lower than what is optimal. See JPS598590 CONTROLLER FOR MARINE ENGINE.

BRIEF SUMMARY OF THE INVENTION

This presented invention may adjust the engine speed of the main engine and the pitch of the propeller adaptively and at each instant, such that the operating condition of the main machine will always assume the lowest allowable engine speed and the maximum allowable output according to the load limit curve 10 of the engine manufacturer. This is performed independent of load, weather and current conditions. The method provides, for instance at each time instant, a maximum efficiency for the propeller and the main engine. This is done with regard to, and not exceeding, the engine manufacturer's threshold values.

One of the most important features is that the control of the engine speed of the main engine is carried out directly using an output set point value to a lowest allowable engine speed via the load limit curve 10.

In parallel, the actual output is controlled to correspond to the output set point value by changing the load torque by varying the pitch of the propeller 7, see FIG. 4.

DETAILED DESCRIPTION OF THE INVENTION

In a normal situation, the described method is realized in a microprocessor based control system.

FIG. 4:

1 bridge user board;
2 control cabinet;
3 user board engine room;
4 the engine speed regulator of the main engine;
5 the main engine;
6 turbo assembly;
7 propeller, and
8 shaft output sensor.

The present invention relates to a method for controlling the fuel consumption of a ship. The ship comprises an engine 5, which may also be referred to as a main engine, and a controllable pitch propeller 7. According to the present invention, the torque and engine speed are adjusted to correspond to an output set point value, e.g. a desired or target engine power output value. Purely by way of example, the output set point value may be set using the user board 1.

As a non-limiting example, the torque and engine speed may also be adjusted to correspond to a measured load of the engine 5 whereby the engine load is the amount of air flowing through the engine as a percentage of the theoretical maximum. For instance, the load of the engine 5 may be measured by one or more engine sensors (not shown).

The adjustment of the torque and engine speed is such that the engine is operated in an operating condition with an engine speed and a propeller pitch of the controllable pitch propeller such that the fuel consumption of the ship is brought and/or held within a desired fuel consumption range.

As such, rather than setting the engine speed and the propeller pitch in accordance with a fixed relationship, the method of the present invention proposes that a combination of engine speed and propeller speed is set in order to arrive at a fuel consumption within a desired fuel consumption range. For instance, the above method is not bound by a fixed relationship between the engine speed and the propeller pitch.

Figure 3:
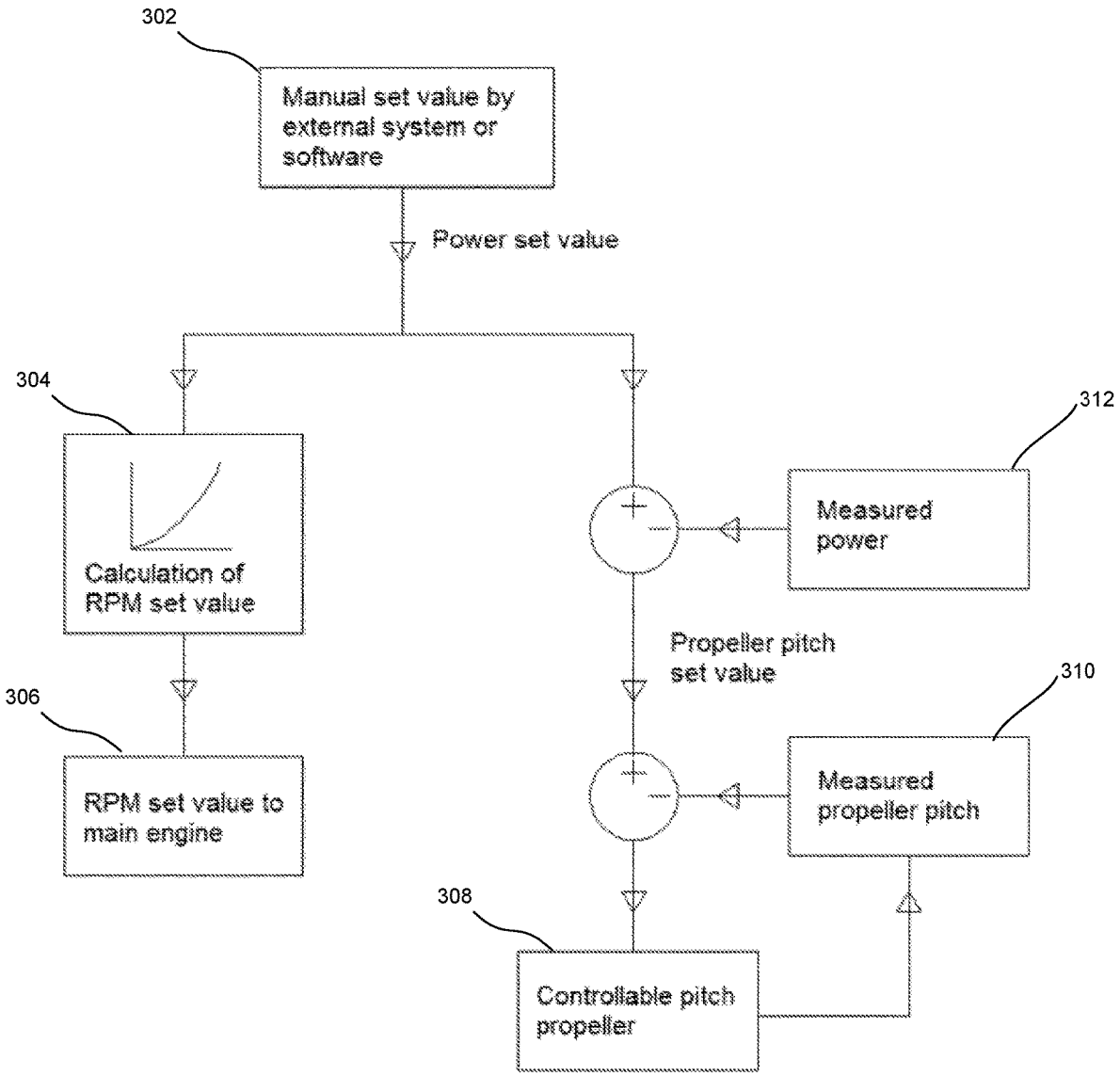
FIG. 3 diagram of control logic.
Figure 4:
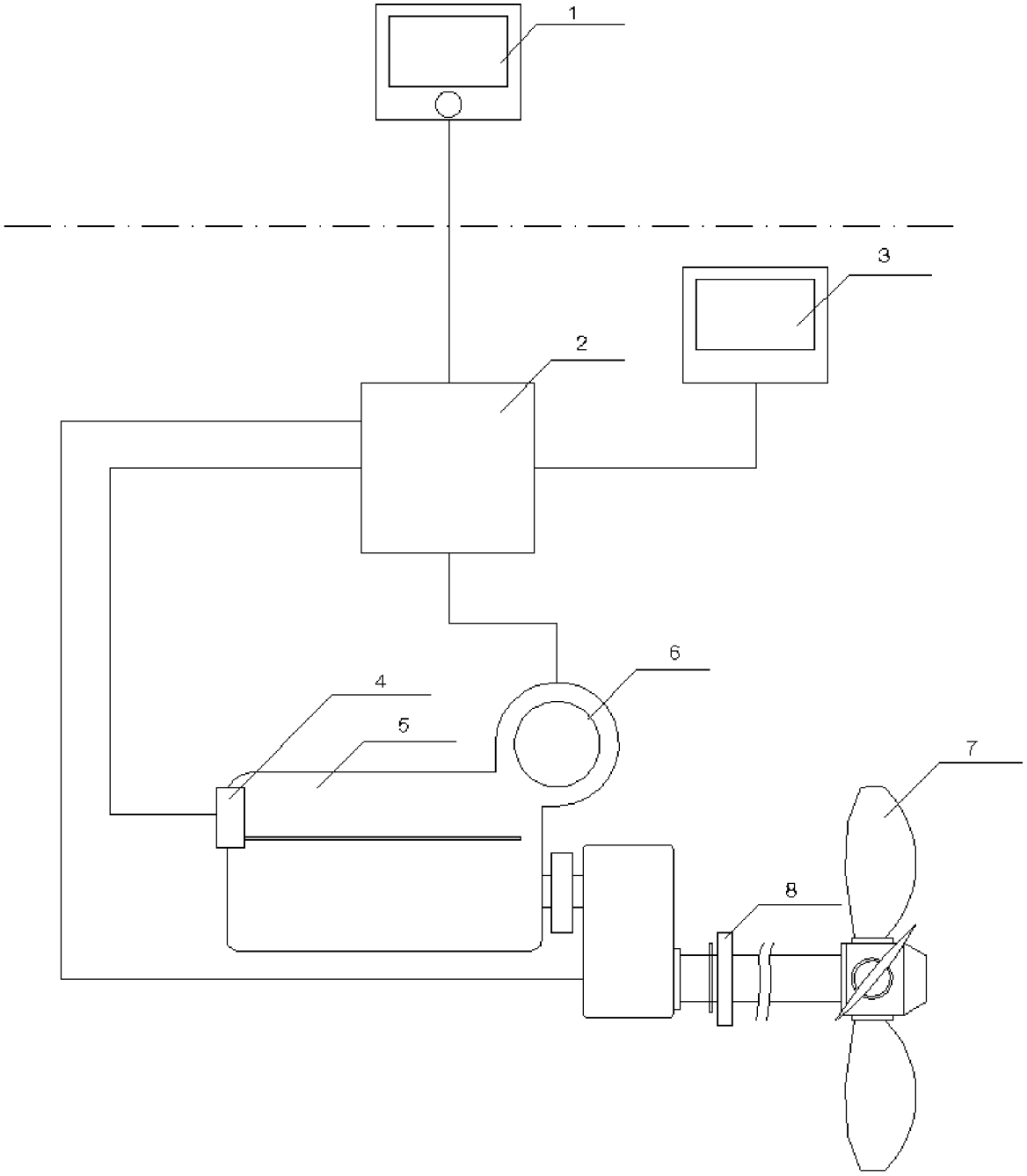
FIG. 4 block diagram of an embodiment.

FIG. 3 illustrates a diagram of control logic. The FIG. 3 example illustrates how the engine speed and the propeller pitch may be determined.

The engine speed may be controlled by an engine control device 302, for instance an electric engine control device. Moreover, the propeller pitch may be set using a pitch setting arrangement 308. Purely by way of example, such a pitch setting arrangement may comprise an adjusting member (not shown) with grooves (not shown) each one of which accommodating a portion of a propeller. The adjusting member may be longitudinally movable to thereby alter the pitch of the propeller.

As a non-limiting example, the engine is operated in an operating condition with as low engine speed and as high propeller pitch as a load limit curve of the engine allows 304. Such an operation implies that the fuel consumption is as low as possible. In other words, the desired fuel consumption range comprises the minimum fuel consumption possible for the output set point value and the load limit curve. The desired fuel consumption range may be relatively narrow and may in certain embodiments only comprise the minimum fuel consumption and a certain margin around the minimum fuel consumption. In other words, the engine is operated in an operating condition that results in a maximum efficiency of the controllable pitch propeller and the engine for a given output set point value.

Figure 1:
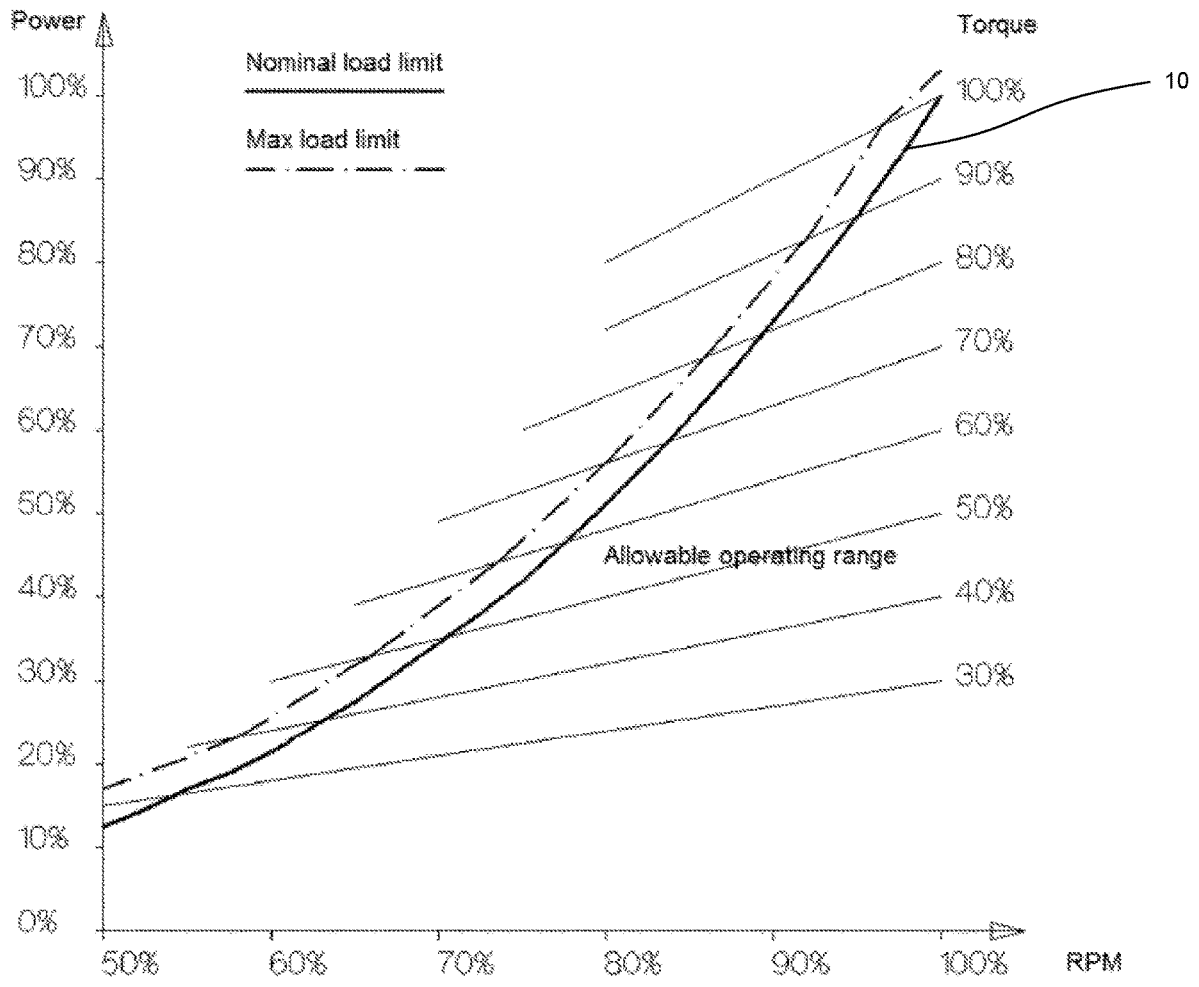
FIG. 1 typical load limit curve for a marine main engine.
Figure 2:
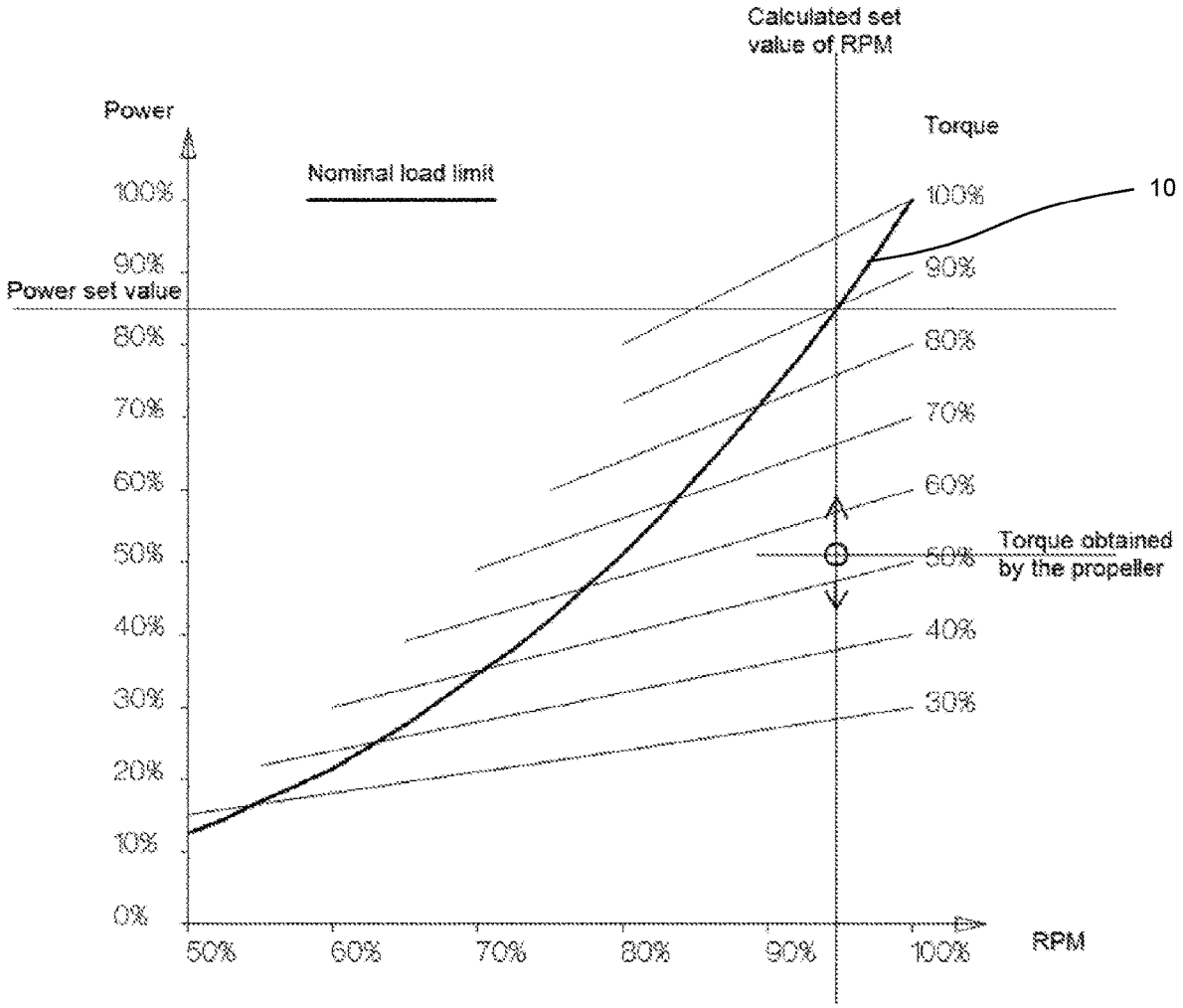
FIG. 2 calculation of an output set value for engine speed and control of torque in order to obtain the correct requested effect.

FIG. 2 illustrates a load limit curve for an engine. As is indicated in FIG. 2, by increasing the propeller pitch, thus increasing the engine torque, it is possible to reduce the engine speed but nevertheless obtain a desired output while maintaining a position at or on the right hand side of the load limit curve. Put differently, by increasing the propeller pitch to thereby increase the engine torque, it is possible to move horizontally to the left in the FIG. 2 diagram in order to arrive at an engine speed and engine torque that produces the desired output.

Purely by way of example, the load limit curve is defined by the engine manufacturer. As another non-limiting example, the load limit curve may be established by running the engine in a test procedure.

As has been intimated above, an output set point value, desired fuel consumption, or desired speed is set by the crew of the ship, wherein this is done from a bridge user board 1 of the ship, or from an external system (not shown).

Preferably, the control of the fuel consumption, preferably the optimization of the fuel consumption, is performed by the system calculating the lowest allowable engine speed from the output set point value and the load limit curve of the main engine and adjusting the engine speed to correspond this.

Preferably, the propeller pitch is automatically adjusted such that the output of the engine corresponds to the output set point.

As a non-limiting example, the output of the engine is measured by a shaft output sensor 8 or is calculated from a fuel rack position (indicative of the amount of fuel currently fed to the engine) and engine speed.

In addition to controlling the engine speed and the propeller pitch of the controllable pitch propeller such that the fuel consumption of the ship is brought and/or held within a desired fuel consumption range, the engine speed and the propeller pitch may also be controlled taking additional effects into account. A few examples are presented hereinbelow.

As a first example, the exhaust gas temperature of the main engine is measured, for instance using a temperature sensor (not shown), and the torque of the main engine is reduced if the temperature exceeds a threshold value. As such, in order to reduce the risk of excessive heating of the engine or an exhaust after treatment system (not shown), the exhaust gas temperature of the engine may be reduced by decreasing the engine torque in the event that a high exhaust gas temperature is detected.

Moreover, the engine speed is increased if the temperature exceeds the threshold value. By increasing the engine speed when decreasing the engine torque, it is possible to at least substantially maintain the output of the engine.

As a second example, if the ship comprises a turbo assembly providing inlet air at a charge pressure to the engine, the charge pressure of the main engine is measured and the torque of the main engine is reduced if the charge pressure is lower than a threshold value given by the engine speed and pressure.

Moreover, as in the first example, the engine speed may be increased if the charge pressure is lower than the threshold value given by the engine speed and pressure.

As a third example, a vibration exciting engine speed is evaluated, the vibration exciting engine speed being an engine speed that may excite an undesired vibration in at least a portion of the ship, the engine speed is increased if the current engine speed is operating within a predetermined engine speed range comprising the vibration exciting engine speed.

Generally, a fuel consumption within a desired fuel consumption range often implies a low engine speed and a high propeller pitch (i.e. a large engine torque). As such, in order to avoid a vibration exciting engine speed, it is generally preferred to increase the engine speed.

As a non-limiting example, the torque of the main engine is reduced if the current engine speed is operating within a predetermined engine speed range comprising the vibration exciting engine speed.

The vibration exciting engine speed and/or the predetermined engine speed range, may be determined in a plurality of ways. Purely by way of example, the vibration exciting engine speed and/or the predetermined engine speed range may be determined by performing an analysis, such as an FE-analysis, of the ship in order to determine resonance frequencies. As another alternative, the vibration exciting engine speed and/or the predetermined engine speed range may be determined by a test procedure during which e.g. resonance frequencies of the ship are determined.

However, in a preferred embodiment of the method, the ship comprises one or more vibration sensors (not shown) adapted to detect vibrations in one or more portions of the ship. As such, in such an embodiment, the vibration exciting engine speed is determined by measuring vibrations levels in at least a portion of the ship. Thus, the vibration exciting engine speed and/or the predetermined engine speed range may be determined during use.

It should be noted that two or more of the above three examples may be combined.

A second aspect of the present invention relates to a computer program comprising program code means for performing the steps of any one of the above method embodiments when the program is run on a computer.

A third aspect of the present invention relates to a computer readable medium carrying a computer program comprising program code means for performing the steps of any one of the above method embodiments when the program product is run on a computer.

A fourth aspect of the present invention relates to a control unit for controlling the fuel consumption of a ship, the control unit being configured to perform the steps any one of the above method embodiments.

Another embodiment example is presented hereinbelow.

The system is normally controlled from a bridge user board 1. On this, a user may adjust a set value, for instance output, speed over ground, or consumption 302. The selected set value is converted or adjusted to an output set value 306. The user board 1 has a graphic interface from which set and actual parameters may be read.

The signal from the user board 1 is sent to the control cabinet 2 in which all the calculations are performed 304. The control cabinet 2 comprises the electronic interface for measured and control data from the main engine 5, the engine speed regulator 4, the turbo assembly 6, the propeller 7 and possibly the shaft output sensor 8. In the engine room or its control room, an additional user board 3 is present for setup of the system and data reading.

The user interface is, during normal operation, the bridge user board 1 using which a desired value that can be output, consumption or speed is set.

The method for which a patent is sought is applied by calculating the correct engine speed in the control cabinet 2 of the system. The calculation is performed by an electronic control unit. The calculated set value is sent to the engine speed regulator 4 of the main engine which in turn adjusts the engine speed to the correct value. The correct output is calculated in the control cabinet 2. The calculation is performed by an electronic unit. The actual output is controlled to correspond to the set value since the system adjusts the pitch of the propeller 7 (308, 310).

Measurement of the actual output 312 is performed by means of the control cabinet 2 of the system reading a signal for the torque and engine speed from the shaft output sensor 8 or a pump rod position and engine speed from the engine speed regulator 4 of the main engine.

The system comprises a safety mechanism, wherein the exhaust gas temperature of the main engine 5 is measured and compared to a threshold value. If the actual temperature exceeds the threshold value, the load is reduced by increasing the engine speed and reducing the torque.

The system comprises a safety mechanism, wherein the charge pressure of the turbo assembly 6 is compared to a threshold value. The threshold value is defined as a function of pressure and engine speed. If the actual pressure is lower than this threshold value, the load is reduced by increasing the engine speed and reducing the torque.

As non-limiting examples, embodiments of the present invention may be described in accordance with any one of the below points.

Point 1. A method for minimizing the fuel consumption of a ship wherein the torque and the engine speed are continuously adjusted to correspond to an output set point value and a measured load, characterized in that the adjustment is such that the engine is operated in an operating condition with as low engine speed and as high propeller pitch as the load limit curve, defined by the engine manufacturer, allows.

Point 2. The method according to point 1, characterized in that an output set point value, desired fuel consumption, or desired speed is set by the crew, wherein this is done from a separate control panel (e.g. bridge user board 1), or from an external system.

Point 3. A method according to point 2, characterized in that the optimization is performed by the system calculating the lowest allowable engine speed from the output set point value and the load limit curve of the main engine and adjusting the engine speed to this.

Point 4. A method according to point 3, characterized in that the propeller pitch is automatically adjusted such that the output of the main engine corresponds to the output set point.

Point 5. A method according to point 4, characterized in that the output of the main engine is measured by a shaft output sensor or is calculated from a pump rod position and engine speed.

Point 6. A method according to point 5, wherein the exhaust gas temperature of the main engine is measured, characterized in that the torque of the main engine is reduced and the engine speed is increased if the temperature exceeds a threshold value.

Point 7. A method according to point 5, wherein the charge pressure of the main engine is measured, characterized in that the torque of the main engine is reduced and the engine speed is increased if the temperature is lower than a threshold value given by the engine speed and pressure.

The invention claimed is:

1. A method for controlling a fuel consumption of a ship, the ship comprising an engine and a controllable pitch propeller, wherein torque and engine speed are adjusted to correspond to an output set point value, wherein the adjustment is such that the engine is operated in an operating condition with the engine speed and a propeller pitch of the controllable pitch propeller such that the fuel consumption of the ship is brought and/or held within a desired fuel consumption range, the fuel consumption being controlled by measurement of an exhaust gas temperature of the engine such that when the exhaust gas temperature exceeds a threshold value, the torque of the engine is reduced by controlling the propeller pitch of the controllable pitch propeller.

2. The method according to claim 1, wherein when the torque of the engine is reduced and the engine speed is increased, the torque of the engine and the engine speed still correspond to the output set point value if the exhaust gas temperature exceeds the threshold value.

3. The method according to claim 1, wherein the engine is operated in the operating condition with the engine speed as low and the propeller pitch as high as a load limit curve of the engine allows.

4. The method according to claim 3, wherein the desired fuel consumption range comprises a minimum fuel consumption possible for the output set point value and the load limit curve.

5. The method according to claim 3, wherein the load limit curve is defined by an engine manufacturer.

6. The method according to claim 1, wherein the output set point value, desired fuel consumption, or desired speed is set by a crew of the ship, wherein this is done from a control panel of the ship, or from an external system.

7. The method according to claim 1, wherein the control of the fuel consumption is performed by a system calculating a lowest allowable engine speed from the output set point value and a load limit curve of the engine and adjusting the engine speed to correspond to the lowest allowable engine speed.

8. The method according to claim 1, wherein the propeller pitch is automatically adjusted such that an output of the engine corresponds to the output set point value.

9. The method according to claim 1, wherein output of the engine is measured by a shaft output sensor or is calculated from a fuel rack position and engine speed.

10. The method according to claim 1, wherein a charge pressure of the engine is measured and the torque of the engine is reduced if the charge pressure is lower than a threshold value given by the engine speed.

11. The method according to claim 10, wherein the engine speed is increased if the charge pressure is lower than said threshold value given by the engine speed.

12. The method according to claim 1, wherein a vibration exciting engine speed is evaluated, the vibration exciting engine speed being an engine speed that excites a vibration in at least a portion of the ship, wherein the engine speed is increased if a current engine speed is operating within a predetermined engine speed range comprising the vibration exciting engine speed.

13. The method according to claim 12, wherein the torque of the engine is reduced if the current engine speed is operating within the predetermined engine speed range comprising the vibration exciting engine speed.

14. The method according to claim 12, wherein the vibration exciting engine speed is determined by measuring vibrations levels in at least a portion of the ship.

15. A control unit for controlling a fuel consumption of a ship, the control unit being configured to:

adjust torque and engine speed to correspond to an output set point value, wherein an engine, based on the adjustment, operates in an operating condition with the engine speed and a propeller pitch such that the fuel consumption of the ship is brought and/or held within a desired fuel consumption range;

measure an exhaust gas temperature of the engine; and when the exhaust gas temperature of the engine exceeds a threshold value, reduce the torque of the engine by controlling the propeller pitch of the controllable pitch propeller.

16. A method for minimizing a fuel consumption of a ship, wherein a torque and an engine speed, from a set point value, are adjusted based on a load limit curve of a main engine and a measured load, wherein the adjustment is performed such that the main engine is operated at an operating point with a lowest possible fuel consumption, with a requested output and as close to the load limit curve as possible, wherein a set point value for output, desired fuel consumption, or desired speed is set by a crew, from a separate control panel, or from an external system, wherein an optimization is performed by a system calculating a lowest allowable engine speed from the set point value and the load limit curve of the main engine and adjusting the engine speed to this, wherein a propeller pitch is automatically adjusted such that the output of the main engine corresponds to the set point value, wherein the output of the main engine is measured by a shaft output sensor or is calculated from a pump rod position and engine speed, the fuel consumption being controlled by measurement of an exhaust gas temperature of the engine such that when the exhaust gas temperature exceeds a threshold value, the torque of the engine is reduced by controlling the propeller pitch of the controllable pitch propeller.

* * * * *